US009926752B2

(12) United States Patent
Adams et al.

(10) Patent No.: US 9,926,752 B2
(45) Date of Patent: Mar. 27, 2018

(54) ROD HANDLING ASSEMBLY

(71) Applicant: Swick Mining Services Ltd, South Guilford (AU)

(72) Inventors: Wayne Adams, Atwell (AU); Paul Attiwell, Mullaloo (AU); David Christopher Williams, Oakford (AU)

(73) Assignee: Swick Mining Services Ltd., South Guildford (AU)

( * ) Notice: Subject to any disclaimer, the term of this patent is extended or adjusted under 35 U.S.C. 154(b) by 305 days.

(21) Appl. No.: 13/887,495

(22) Filed: May 6, 2013

(65) Prior Publication Data

US 2013/0309044 A1 Nov. 21, 2013

(30) Foreign Application Priority Data

May 8, 2012 (AU) ..... 2012901875

(51) Int. Cl.

| | |
|---|---|
| ***E21B 19/15*** | (2006.01) |
| ***E21B 19/14*** | (2006.01) |
| ***E21B 19/16*** | (2006.01) |
| ***E21B 19/20*** | (2006.01) |

(52) U.S. Cl.

CPC ..... *E21B 19/14* (2013.01); *E21B 19/15* (2013.01); *E21B 19/168* (2013.01); *E21B 19/20* (2013.01)

(58) Field of Classification Search

CPC ..... E21B 19/14; E21B 19/15; E21B 19/168; E21B 19/20; F16L 1/09; F16L 1/06; Y10S 414/123; Y10S 901/40; B66C 1/62; B66C 1/04; B65G 47/904; B65G 47/907; B65G 47/92

USPC .... 414/22.51–22.71, 745.1–746.8, 910, 911; 294/87.22, 87.24

See application file for complete search history.

(56) References Cited

U.S. PATENT DOCUMENTS 2,593,498 A * 4/1952 Stone ..... E21B 19/168 81/64
3,145,786 A * 8/1964 O'Neill et al. ..... 175/85
(Continued)

FOREIGN PATENT DOCUMENTS

WO WO 01/23701 A1 4/2001 ..... E21B 19/09
WO WO 2004/079154 A1 9/2004 ..... E21B 19/10

*Primary Examiner* — Anna M Momper
*Assistant Examiner* — Lynn E Schwenning
(74) *Attorney, Agent, or Firm* — Sunstein Kann Murphy & Timbers LLP

(57) ABSTRACT

A rod handling assembly 10 has a surface engagement mechanism 12 capable of engaging an exposed surface of a drill rod R and a holding mechanism 14 coupled to the surface engagement mechanism 12. The system 10 and more particularly the mechanisms 12 and 14 engage and hold the rod R from a location radially adjacent a circumferential surface of the rod R inboard of its opposite ends, rather than from an end of the rod R. The surface engagement mechanism 12 is a distributed mechanism having two parts 12*a* and 12*b* that act at axially spaced locations on the rod R. The holding mechanism 14 is located and operates on the rod R between these axially spaced locations. The surface engagement mechanism 12 initially operates to engage the surface of the rod R which may for example be lying on a rod tray, to enable the rod to be lifted from a tray. Thereafter the holding mechanism 14 is operable to support and hold the rod.

33 Claims, 10 Drawing Sheets

(56) References Cited

U.S. PATENT DOCUMENTS 3,773,185 A * 11/1973 Johnson ..... B66C 1/04 212/316
4,044,894 A * 8/1977 McDonald ..... B66C 1/06 294/65.5
4,212,577 A * 7/1980 Swanson ..... 414/23
4,397,605 A * 8/1983 Cowgill et al. ..... 414/22.71
4,509,891 A * 4/1985 Lipscomb ..... B65G 61/00 198/345.1
5,062,756 A * 11/1991 McArthur et al. ..... 414/22.51
5,127,790 A * 7/1992 Teague ..... E21B 19/155 414/22.51
5,411,304 A * 5/1995 Muto ..... B66C 1/06 294/106
5,451,129 A * 9/1995 Boyadjieff ..... B65G 1/0442 414/22.61
5,520,072 A * 5/1996 Perry ..... E21B 19/163 81/57.16
6,538,544 B1 * 3/2003 Hardy ..... B66C 1/04 294/192
6,808,359 B2 * 10/2004 Miglioranza ..... B21D 43/006 414/745.1
6,814,164 B2 * 11/2004 Mills et al. ..... 175/52
6,926,488 B1 * 8/2005 Bolding ..... E21B 19/15 211/70.4
7,044,706 B2 * 5/2006 Jung ..... B25J 15/0052 294/119.1
7,191,686 B1 * 3/2007 Angelle ..... E21B 19/163 81/57.16
7,331,746 B2 * 2/2008 Wright et al. ..... 414/22.65
7,707,914 B2 * 5/2010 Pietras et al. ..... 81/57.16
7,849,929 B2 * 12/2010 Littlely ..... 166/380
7,918,636 B1 * 4/2011 Orgeron ..... 414/22.55
2002/0066339 A1 * 6/2002 Price et al. ..... 81/57.33
2002/0079137 A1 6/2002 Mills et al. ..... 175/52
2002/0144575 A1 10/2002 Niven ..... 81/57.39
2003/0132030 A1 * 7/2003 Tompkins ..... E21B 19/20 175/52
2008/0006806 A1 * 1/2008 Hall ..... B66C 1/28 254/362
2009/0053014 A1 * 2/2009 Ge ..... E21B 19/168 414/22.61
2009/0277626 A1 11/2009 Littlely ..... 166/77.51
2010/0187740 A1 7/2010 Orgeron ..... 269/218
2011/0008143 A1 * 1/2011 Del Fabro ..... B21F 23/005 414/745.7
2011/0103922 A1 * 5/2011 Belik ..... E21B 19/24 414/22.58
2012/0297933 A1 * 11/2012 Lavalley ..... E02F 3/965 81/57.34

* cited by examiner

ROD HANDLING ASSEMBLY

FIELD OF THE INVENTION

The field of the invention relates to a rod handling assembly and in particular, but not exclusively, to a rod handling assembly for handling drill rods and core barrels of the type used in drill rigs.

BACKGROUND OF THE INVENTION

A drill rig which operates by advancing a drill string composed of a plurality of connected drill rods requires a system for handling the individual drill rods. This system is needed to transfer individual drill rods between the drill string and a storage facility such as a rod tray or bin. When the drill rig is in operation drilling a hole, additional drill pipes must be connected into the string in order to advance the hole. This requires the transfer of drill rods from the storage facility to the drill string. Conversely, when the drill string is being tripped, individual rods are broken out of the string and moved to the storage facility. A rod handling system includes a lifting device such as a hoist or mechanical arm, together with a rod handling assembly that can selectively engage and disengage a drill rod. Thus, when a drill rod is engaged by the rod handling assembly, the associated hoist or arm is operated to transfer the rod between the drill string and the storage facility.

SUMMARY OF THE INVENTION

In a first aspect the invention provides a rod handling assembly comprising:

a surface engagement mechanism capable of engaging an exposed surface of a rod; and, a holding mechanism coupled to the surface engagement mechanism, the holding mechanism capable of holding a rod engaged by the surface engagement mechanism.

In a second aspect the invention provides a rod handling assembly comprising:

a surface engagement mechanism capable of engaging an exposed surface of a rod to facilitate lifting of the rod; and, a holding mechanism coupled to the surface engagement mechanism, the holding mechanism capable of holding a rod engaged by the surface engagement mechanism, wherein each of the surface engagement mechanism and holding mechanism can engaged the rod when disposed radially adjacent a circumferential surface of the rod.

In a third aspect the invention provides a rod handling assembly comprising:

a surface engagement mechanism capable of engaging an exposed surface of a rod without encircling the rod to facilitate lifting of the rod; and, a holding mechanism coupled to the surface engagement mechanism, the holding mechanism capable of holding a rod engaged by the surface engagement mechanism, the holding mechanism having an open state enabling the surface engagement mechanism to engage the rod and a closed state where the holding mechanism can encircle the rod from a location radially adjacent a circumferential surface of the rod location and inboard of opposite end of the rod.

In a fourth aspect the invention provides a rod handling assembly comprising:

a surface engagement mechanism capable of engaging an exposed surface of a rod, the surface engagement mechanism arranged to act at two or more axially spaced locations on the rod; and, a holding mechanism coupled to the surface engagement mechanism, the holding mechanism capable of holding a rod engaged by the surface engagement mechanism about a circumferential portion of the rod disposed between two of the axially spaced locations.

In an embodiment of the first second and fourth aspect the holding mechanism has an open state enabling the surface engagement mechanism to engage the rod and a closed state where the holding mechanism can encircle the rod from a location radially adjacent a circumferential surface of the rod location and inboard of opposite end of the rods.

In one embodiment the holding mechanism is capable of holding a rod after the surface engagement mechanism has released that rod.

In one embodiment the holding mechanism is operable to switch between an opened state and a closed state, wherein a rod engaged by the surface engagement mechanism is held by the holding mechanism by switching the holding mechanism from the opened state to the closed state.

In one embodiment the holding mechanism is configured to hold a rod by extending about a circumference of the rod.

In one embodiment the holding mechanism is arranged to rotatably hold a rod wherein a rod held by the holding mechanism is able to rotate about a longitudinal axis of the rod.

In one embodiment the holding mechanism comprises at least one rotatable member which contacts a rod held by the holding mechanism.

In one embodiment the rod rests on the at least one of the rotatable member when held by the holding mechanism.

In one embodiment the rod handling assembly comprises a motor arranged to rotate the at least one rotatable member and thereby cause rotation of a rod held by the holding mechanism.

In one embodiment the at least one rotatable member comprises a respective roller.

In one embodiment the at least one rotatable member comprises a group of one or more wheels rotatably mounted on a common axis.

In one embodiment the holding mechanism comprises a body and at least one claw structure coupled and movable relative to the body wherein the claw structure is moved to a first position when the holding mechanism is in the opened state and the claw structure is moved to a second position when the holding mechanism is in the close state.

In one embodiment the holding mechanism comprises a single claw structure and the single claw structure supports at least two of the rotatable members.

In one embodiment the holding mechanism comprises two claw structures and each claw structure supports at least one of the rotatable members.

In one embodiment the claw structures are arranged to pivotally move between the first and second positions.

In one embodiment the two claw structures are arranged to linearly move between the first and second positions.

In one embodiment the body supports a third rotatable member.

In one embodiment the claw structures are arranged to be manually movable between the first and second positions.

In one embodiment the rod handling assembly comprises a latch arranged to hold the structures in either of the first and second positions.

In one embodiment the rod handling assembly comprises an actuator arranged to move the or each claw structure to the first position.

In one embodiment the actuator is selected from the group consisting of: an electrically powered actuator, a hydraulically powered actuator and a pneumatically powered actuator.

In one embodiment the rod handling assembly comprises one or more springs arranged to bias the or each claw structure to the second position, and wherein the actuator operates against the bias of each spring to move each claw structure to the first position.

In one embodiment the surface engagement mechanism comprises at least one electromagnet.

In one embodiment the surface engagement mechanism comprises two electromagnets, one on each side of the holding mechanism.

In one embodiment the surface engagement mechanism comprises at least one permanent magnet.

In one embodiment the surface engagement mechanism comprises two permanent magnets, one on each side of the holding mechanism In one embodiment the or each permanent magnet comprises a bar magnet having a longitudinal face of a first surface area and an end face of a second surface area wherein the first surface area is greater than the second surface area; and the assembly comprises a device for moving the or each permanent magnet between an engaged position where a respective longitudinal face lies parallel to a rod held or to be held by the holding mechanism and a disengaged position where the respective longitudinal face lies perpendicular to a or the rod held or to be held by the holding mechanism.

In one embodiment the surface engagement mechanism comprises a vacuum.

BRIEF DESCRIPTION OF THE DRAWINGS

Embodiments of the rod handling assembly will now be described by way of example only with reference to the accompanying drawings in which.

DETAILED DESCRIPTION OF THE PREFERRED EMBODIMENTS

Figure 1:
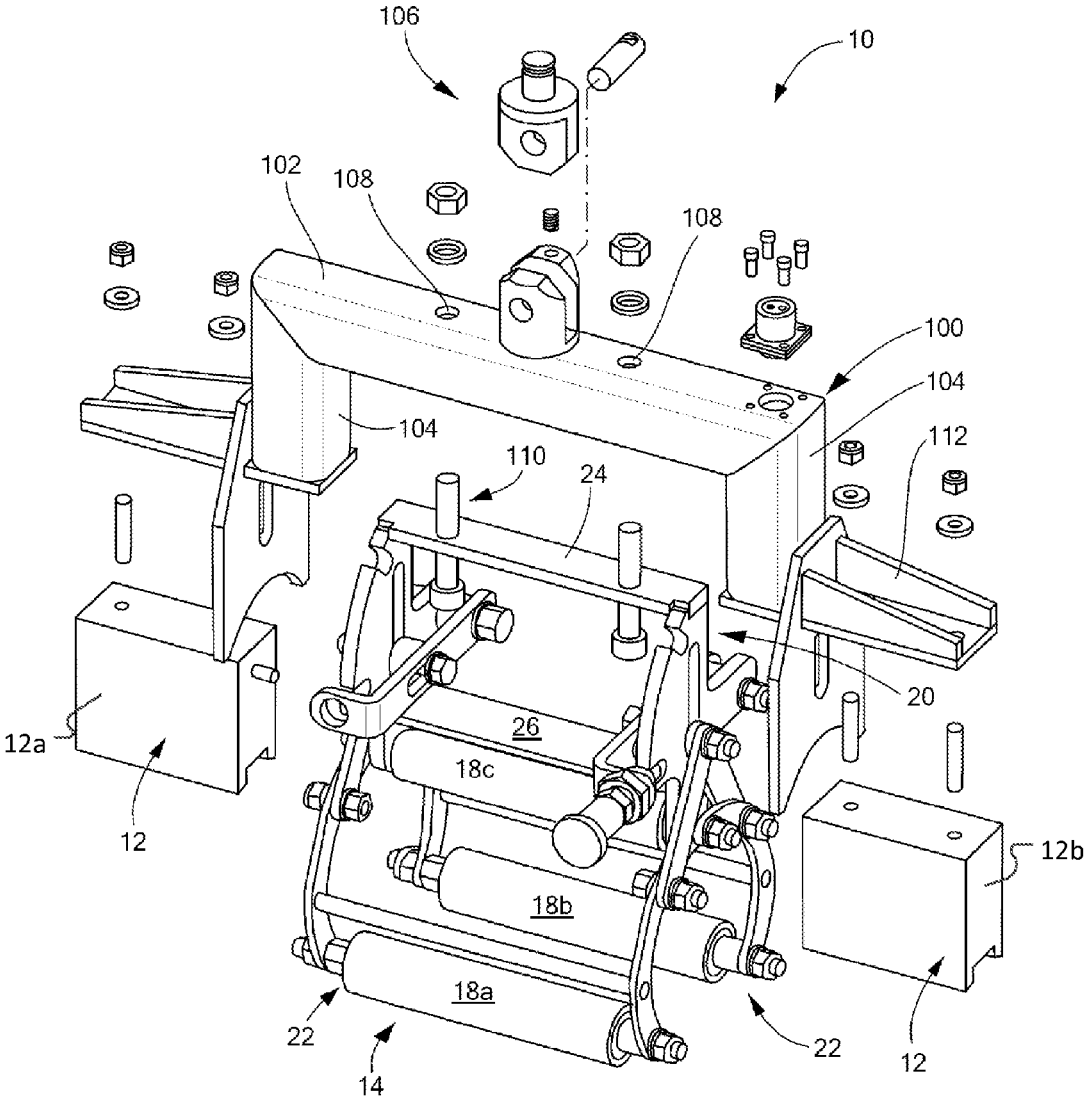
FIG. 1 is an exploded view of a first embodiment of the rod handling assembly.

With reference to the accompanying drawings and in particular FIGS. 1-5, an embodiment of a rod handling assembly 10 comprises a surface engagement mechanism 12 capable of engaging an exposed surface of a drill rod R (shown in phantom line in FIG. 3) and a holding mechanism 14 coupled to the surface engagement mechanism 12. The surface engagement mechanism 12 is a distributed mechanism having two parts 12*a* and 12*b* that act at axially spaced locations on the rod R. The holding mechanism 14 is located and operates on the rod R between these axially spaced locations. The surface engagement mechanism 12 initially operates to engage the surface of the rod R which may for example be lying on a rod tray, to enable the rod to be lifted from a tray. Thereafter the holding mechanism 14 is operable to support and hold the rod. The surface engagement mechanism 12 can then be disengaged or de-energised so that the rod handling assembly 10 maintains a hold of the rod by virtue of the holding mechanism 14 only. The initial engagement of the rod by the surface engagement mechanism 12 is to enable the rod to be lifted a sufficient distance from an underlying support or storage facility so that the holding mechanism 14 can operate to hold or grip the rod. In this regard the rod handling assembly 10 is configured to engage about a circumferential portion of the rod R from a location radially adjacent a circumferential surface of the rod and inboard of opposite end of the rod. That is the system 10 and more particularly the mechanisms 12 and 14 engage and hold the rod R from the side of the rod R rather than from an end of the rod R.

Figure 2:
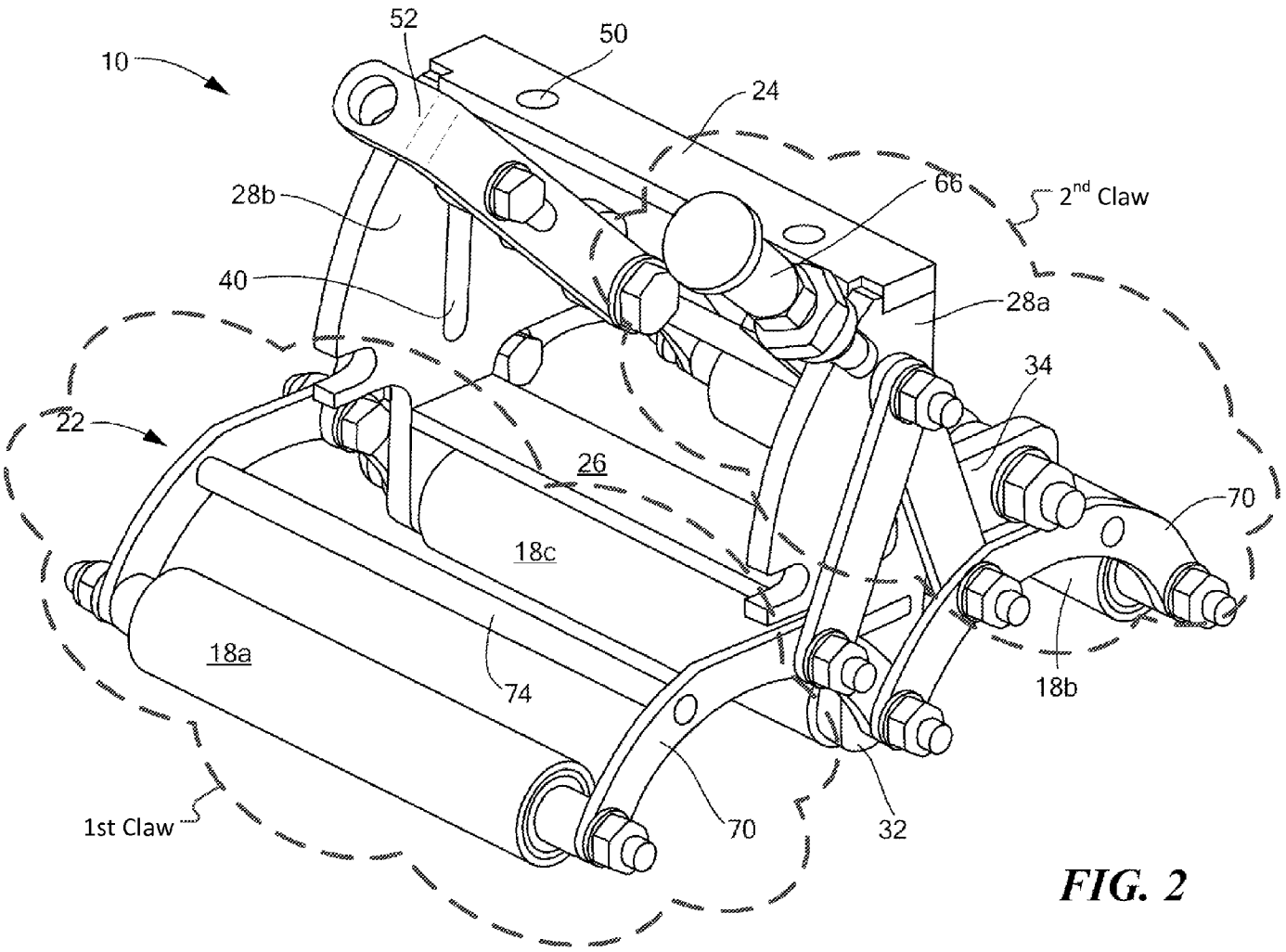
FIG. 2 is an isometric view of a holding mechanism incorporated in the rod handling assembly when in an opened state.

The assembly 10 is suspended from a cable of a hoist 16 or other lifting machine. When it is desired for example to transfer a drill rod R from a drill tray to a drill rig, the hoist 16 is operated to position the apparatus 10 adjacent and directly above one of the rods. During this process, the holding mechanism 14 is in the opened state as shown in FIG. 2. The system 10 is moved to a location radially adjacent a circumferential surface of the rod location and inboard of opposite end of the rod R with the surface engagement mechanism 12 and each part 12*a* and 12*b* in close proximity to or touching the surface of the rod R. The surface engagement mechanism 12 is now activated to engage the exposed surface of underlying rod R. The surface engagement mechanism 12 does not encircle the rod R, it only requires to contact or act on a surface area spanning a relative small arc (for example up to about 60° or less such as up to 10°-30°) of the circumference of the rod R. The rod R is lifted a short distance sufficient to enable the holding mechanism 14 to be switched to its closed state shown in FIG. 3. When the holding mechanism 14 is switched to its closed state it wraps around and under the rod R to support and hold the rod R. If desired, the surface engagement mechanism 12 can now be deactivated. The rod R held by the assembly 10 may now be positioned as desired by appropriate operation of the hoist 16.

The holding mechanism 14 is arranged to hold a rod R in a manner enabling it to be rotated about its longitudinal axis. This functionality is provided by the provision of at least one rotatable member. But in this specific embodiment there are three rotatable members in the form of rollers 18*a*, 18*b* and 18*c* (hereafter referred to in general as "rollers 18"). The rollers contact the rod at circumferentially spaced locations.

The holding mechanism 14 comprises a body 20 and two claw structures 22 that are coupled to the body 20. The body 20 comprises two strips 24 and 26 which are spaced apart and are coupled at opposite ends to respective side plates 28*a* and 28*b* (hereinafter referred to in general as "side plates 28"). Each side plate 28 comprises a quarter circle portion 30 and two integrally formed radially extending arms 32 and 34. The quarter circle portion 30 has a curved edge 34 and a straight edge 38. The arm 32 extends down from the quarter circle portion 30 in alignment with the straight edge 38, while the arm 34 extends perpendicular to the straight edge 38.

A longitudinal slot 40 is formed in the quarter circle portion 30 and extends parallel to the straight edge 38. Notches 42 and 44 are formed in the curved edge 36 of the quarter circle portion 30. The notches 42 and 44 are spaced apart by an angle of approximately 75°. Holes 46 and 48 are formed in the arms 32 and 34 respectively and mounting holes 50 are formed in the strip 24.

A lever 52 is pivotally coupled to each of the side plates 28. Each lever 52 is in the form of an L-shape strip having a hole 54 near the top of the leg of the "L" and a hole 56 in the foot of the "L". A longitudinal slot 58 is also formed in the leg of the "L". Each lever 52 is connected to a respective side plate 28 by two fasteners 60 and 62. Fastener 60 passes through hole 54 and hole 48, and forms a pivot axle for the lever 52. The fastener 62 passes through the slots 58 and 40. Spacers 64 are located on the fasteners 60 and 62 and disposed between the lever 52 and its adjacent coupled side plate 28. The levers 52 are connected or arranged on the body 20 so that the leg of each lever resides between the side plates 28 with the foot of each lever 52 pointing outwardly of the body 20. The fastener 62 acts as a guide and is able to slide in both of slots 40 and 58 as the lever 52 is pivoted about the fastener 60. Each of the fasteners 60 and 62 comprises a bolt.

A plunger 66 is fastened to at least one but preferably each lever 52 via its respective hole 56. The plunger 66 has a spring loaded tip 68 that is arranged to seat in one of the notches 42 or 44. The tip 68 can be retracted from a notch 42 or 44 by pulling outwardly on the plunger 66. When the plunger 66 is released, the spring loaded tip 68 is biased in a radial inward direction and will self locate in one of the notches 42 or 44 if the lever 52 is pivoted to a position where the tip 68 and one of the notches are aligned. Thus the plunger 66 together with the notches 42 and 44 acts as a latch. As will be explained shortly, this latch operates to hold the structures 22 in either the first position shown in FIG. 2, or the second position shown in FIG. 3.

Each claw structure 22 comprises two identical curved strips 70 formed with four spaced apart holes 72*a*, 72*b*, 72*c* and 72*d*. Holes 72*a* and 72*d* are near opposite ends of each strip 70, with the holes 72*b* and 72*c* spaced there between. An elongated pin 74 extends between the holes 72*b* and connects the strips 70 of each structure 22 together. A further pin 76 extends between and extends beyond the holes 72*a*. Mounted on the pin 76 between the strips 70 are a pair of spacers 78, and a pair of ball bearings 80. A roll 82 is seated at opposite ends on the respective ball bearings 80. The spacers 78 are disposed between each strip 70 and an adjacent ball bearing 80. The ends of the pin 76 that extend through the holes 72*a* are engaged by nuts 84 which hold the pin 76 and thus the rolls 82 on the structure 22. A washer 86 is located between each of the nuts 84 and the adjacent surface of the strip 70. The roll 82 is able to freely rotate about the pin 76 on its ball bearings 80. The roll 82, bearings 80 and pin 76 together form a respective roller 18.

A straight linkage 88 is attached to each curved strip 70 of each structure 22. The straight linkage 88 is formed with two holes 90 and 92 one near each of its opposite ends. Respective fastener assemblies 94 pass through the holes 72*c* and 90 to couple the respective curved strips 70 and linkages 88 together. Each fastener assembly 94 comprises a bolt, two washers and a nut.

In each claw structure 22, one linkage 88 is on an outside of a curved plate 70 with the other on the inside of the other curved plate 70. Further, the structures 22 are arranged so that the linkages 88 on opposite structures 22 are on different sides of their respective curved strips 70. This is seen most clearly in FIGS. 2 and 3. Respective fastener assemblies 62 engage the holes 92 of the immediately adjacent linkages 88 on the facing structures 22 on respective sides of the body 20. The facing structures 22 are also coupled to the body 20 by further fastener assemblies 96. Respective fastener assemblies 96 pass through the hole 46 of a respective arm 32 as well as the holes 72*d* in the adjacent curved plates 70 on the facing structures 22.

Figure 3:
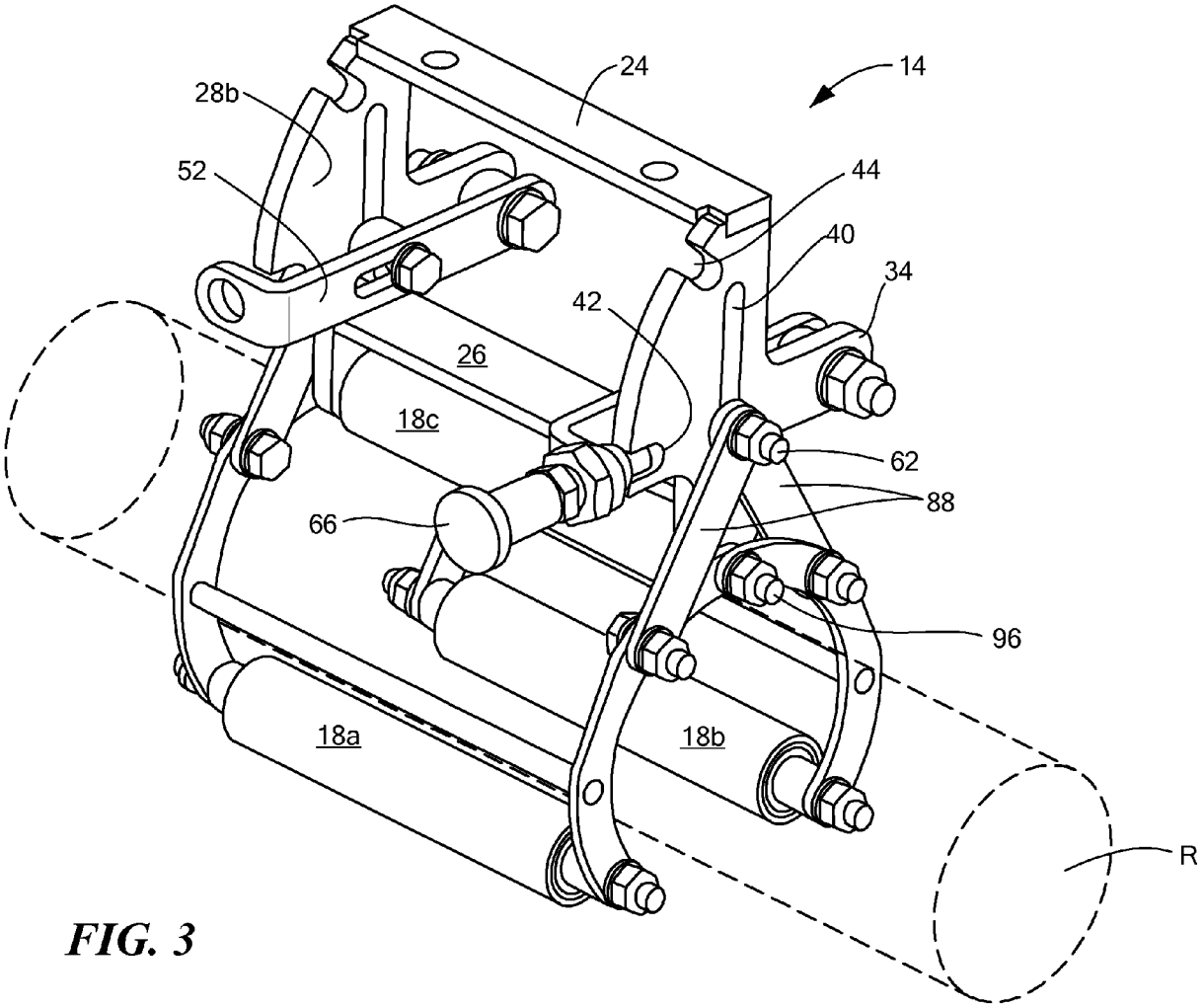
FIG. 3 is an isometric view of the holding mechanism shown in FIG. 2 but now in a closed state.
Figure 4:
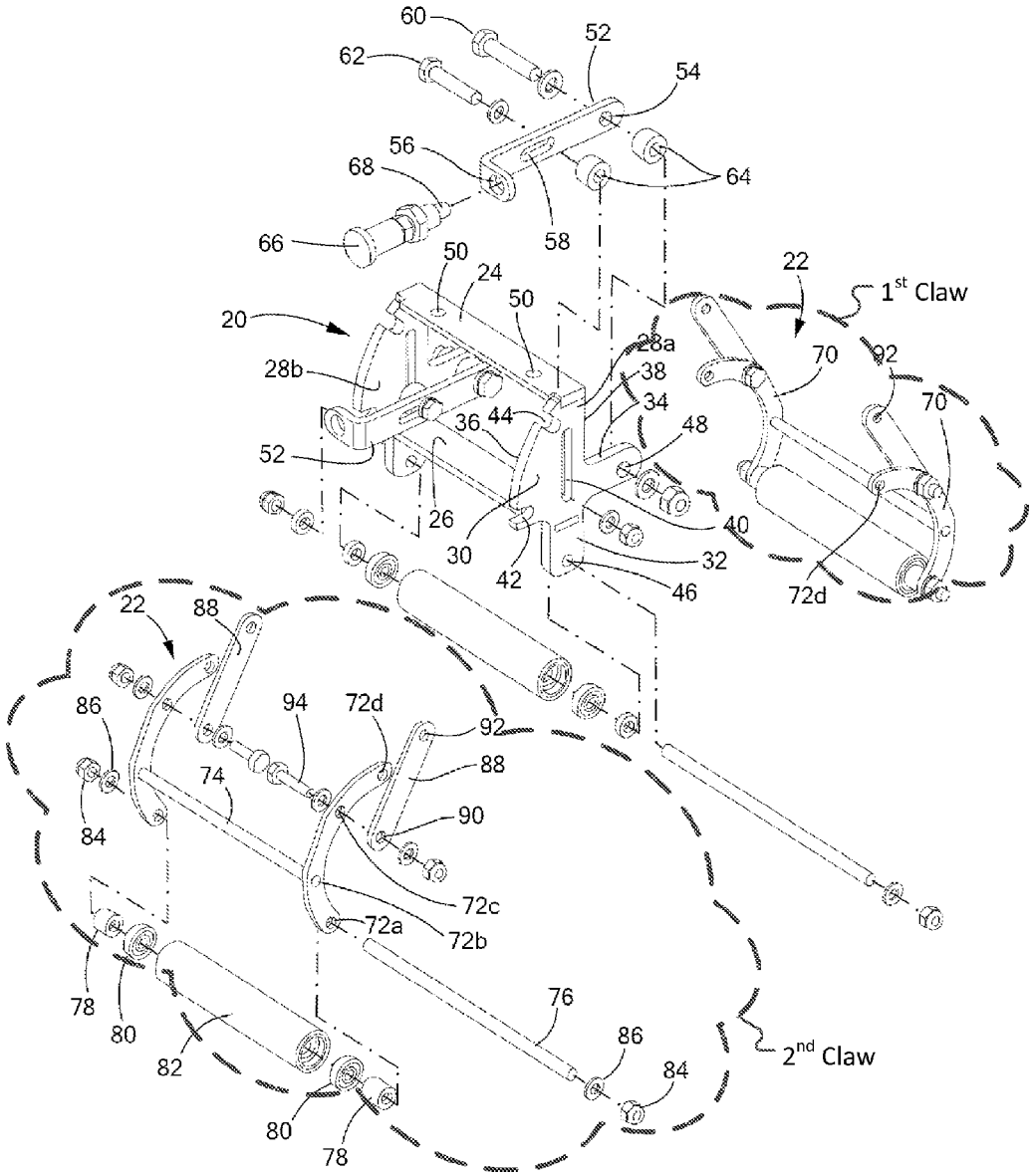
FIG. 4 is an exploded view of the holding mechanism shown in FIGS. 1-3.

By disengaging the plunger 66 and notch 42 or 44, the lever 52 can be pivoted up or down causing the structures 22 to pivot and move in a curved path between the first position shown in FIG. 2 and the closed position shown in FIG. 3.

With particular reference to FIG. 1, the holding mechanism 14 is attached to a frame 100. The frame 100 is formed with a cross bar 102 and two depending arms 104. A swivel 106 is attached at an intermediate location on the cross bar 102 and enables coupling of the assembly 100 to a cable of the hoist 16. Holes 108 are formed in the cross bar 102 on opposite sides of the swivel 106. Fastener assemblies 110 pass through the holes 50 in the strip 24 and through the holes 108 to fasten the holding mechanism 14 to the frame 100.

A mounting bracket 112 is attached on an outside of each arm 104. The surface engaging mechanism 12 is attached to the mounting brackets 112. In this particular embodiment, the surface engaging mechanism 12 comprises electromagnets 12*a* and 12*b*, each attached to a respective bracket 112.

Figure 5:
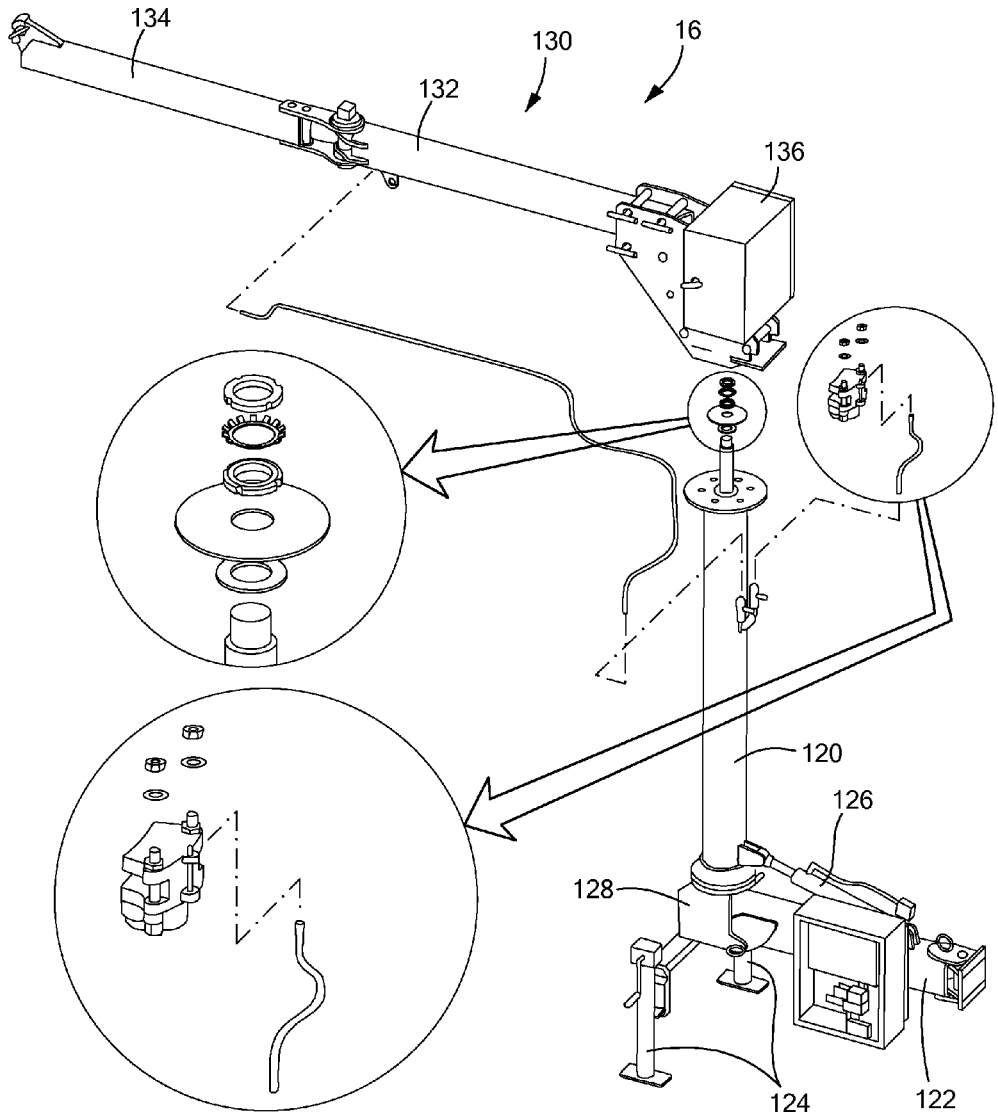
FIG. 5 is a schematic representation of a hoist to which the rod handling assembly can be coupled to form a rod handling system.

FIG. 5 depicts an embodiment of a hoist 16 to which the assembly 10 can be attached. The hoist 16 has an upright mast 120 which is pivotally coupled at a lower end to a brace 122. Stabiliser legs 124 extend from opposite sides at one end of the brace 122 adjacent the mast 120. A hydraulic ram 126 is coupled between the brace 122 at a lower end of the mast 120. A 90° hinge 128 connects the bottom of the mast 120 to the brace 122. By extending the ram 126, the mast 120 can be pivoted to a position substantially parallel to the brace 122 for transport purposes. By retracting the ram 126, the mast 120 is placed in an upright position relative to the brace 122 as shown in FIG. 5. By further retracting the ram 126, the mast 120 can be pivoted beyond the vertical also of transport purposes.

An articulated boom 130 is pivotally mounted on an opposite end of the mast 120. Boom 130 has a first arm 132 and a pivotally coupled second arm 134. A powered (e.g. hydraulic, pneumatic or electric) winch (not shown) is disposed within a housing 136 at an end of the boom 130 adjacent the mast 120. A wire line (not shown) from the winch 136 is connected to the swivel 106 of the rod handling assembly 10.

In one embodiment, the rod handling assembly 10 and hoist 16 may be attached or coupled to an underground drill rig. The drill rig includes a drill motor or rotation head mounted on a carriage which is linearly movable along rail or tower. A drill sting composed of a plurality of end to end connected drill rods R is coupled to the rotation head. During drilling the rail or tower is orientated in a desired drilling angle which may be inclined to the vertical. To perform a drill rod transfer the rail or tower is moved to lie in or near a horizontal plane. Typically an associated drill rod storage facility holds a supply of rods in a substantially horizontal disposition. However if this is not the case then the supply facility is reorientated to hold the rods substantially horizontally. When using the rod handling assembly 10 to transfer a rod R from the storage facility to couple to the drill motor, the surface engaging mechanism 12 is energised or operated to initially engage a rod R in the storage facility. The engagement is with sufficient force to enable the rod R to be lifted by operation of the hoist 16. The hoist 16 is operated to lift the engaged rod R a sufficient distance to enable the holding mechanism 14 to be operated to encircle and grip or otherwise hold the rod R. The surface engaging mechanism 12 can now be released and the hoist 16 operated to move the rod R to an appropriate location to enable it to be screwed onto the drill string.

Due to the provision of the rotatable members 18, the rod R can be rotated while being held in the assembly 10. This rotation may be either by hand, or use of Stilsons or other types of pipe wrenches. In alternate embodiments one or more of the rotatable members 18 may be powered or driven by a motor to cause rotation of the rod R. Once the connection has been made the holding mechanism 14 can be disengaged by operating the plunger 66 to retract the pin 68 from notch 62 and pivoting the lever 52 in an upward direction so as to relocate the pin 68 in the notch 44.

Transferring a rod R from the drill to the storage facility is achieved in substantially the same way except there will normally be no need to operate the surface engaging mechanism 12 as typically there is sufficient clearance about the rod to enable the holding mechanism 14 to extend about the circumference of, and thereby hold, the rod R. However when the rod R is being subsequently loaded back onto the storage facility, the surface engaging mechanism 12 may be activated prior to moving the holding mechanism 14 to the open state so that the rod R can be lowered onto the storage facility rather than simply being dropped onto the storage facility.

Figure 6A:
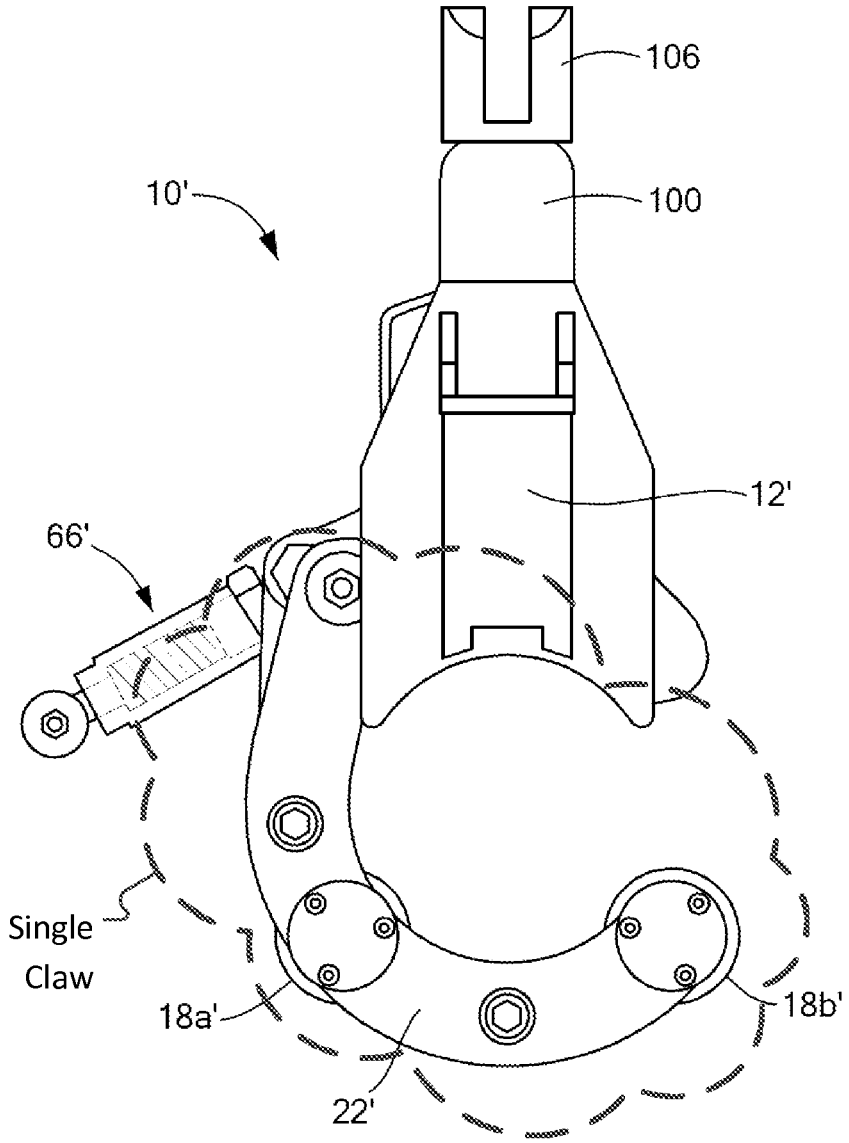
FIG. 6*a* is a side elevation of a second embodiment of the rod handling assembly.
Figure 6B:
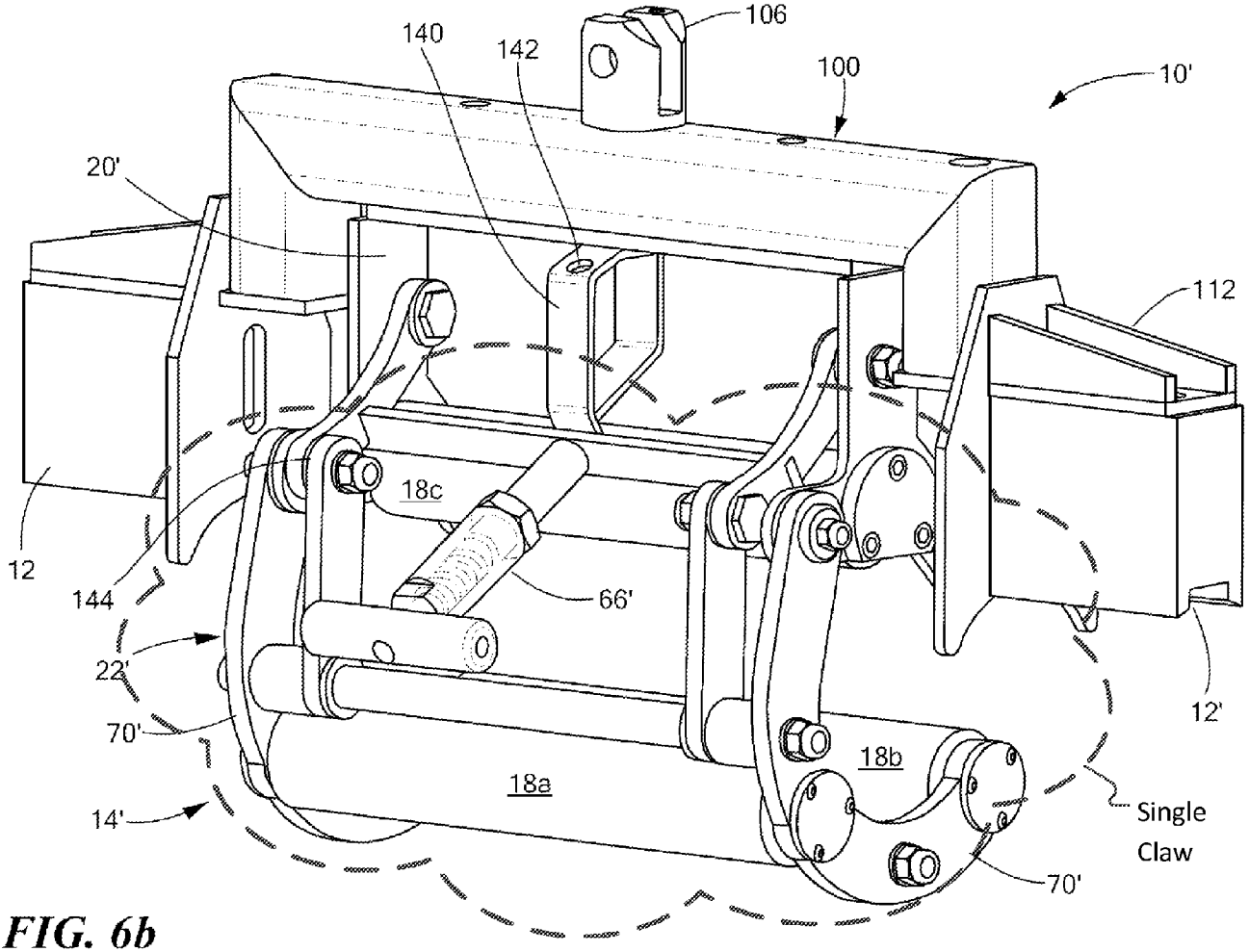
FIG. 6*b* is an isometric view of the second embodiment of the rod handling assembly.

FIGS. 6*a* and 6*b* depict a second embodiment of the rod handling assembly denoted as 10'. The substantive difference between the assemblies 10 and 10' is in the configuration of the holding mechanism. In describing the assembly 10' the same reference numbers as for the assembly 10 are used but with the addition of the prime (') symbol to denote the same or equivalent features. In the assembly 10', the holding mechanism 14' comprises a single structure 22' which supports two rotatable members 18'*a* and 18'*b*. The third rotatable member 18'*c* is rotatably held by the body 20'. The structure 22' comprises two spaced apart strips 70' which have a J-like configuration. The structure 22' is able to pivot or move between first and second positions to switch the holding mechanism 14 between the opened and closed states. The assembly 10' also comprises a latch similar to the first embodiment to latch the holding mechanism 14 in the opened or closed states. The latch comprises a sprung plunger 66' which also acts as a handle to pivot the structure 22'. A tip (not shown) of plunger 66' is able to locate in holes formed in a central bracket 140 of the body 20'. One of the holes 142 is depicted in FIG. 6*b*. When the plunger 66' is engaged with the hole 142 the holding mechanism 14' is in the opened state. However in the configuration shown in FIGS. 6*a* and 6*b* the plunger 66' is engaged with another hole (not shown) on bracket 140 latching the holding mechanism 14' in the closed state. In this embodiment a linkage system 144 couples the structure 22' to the body 20' and facilitates pivotal motion of the structure 22' between the first and second positions.

Figure 7:
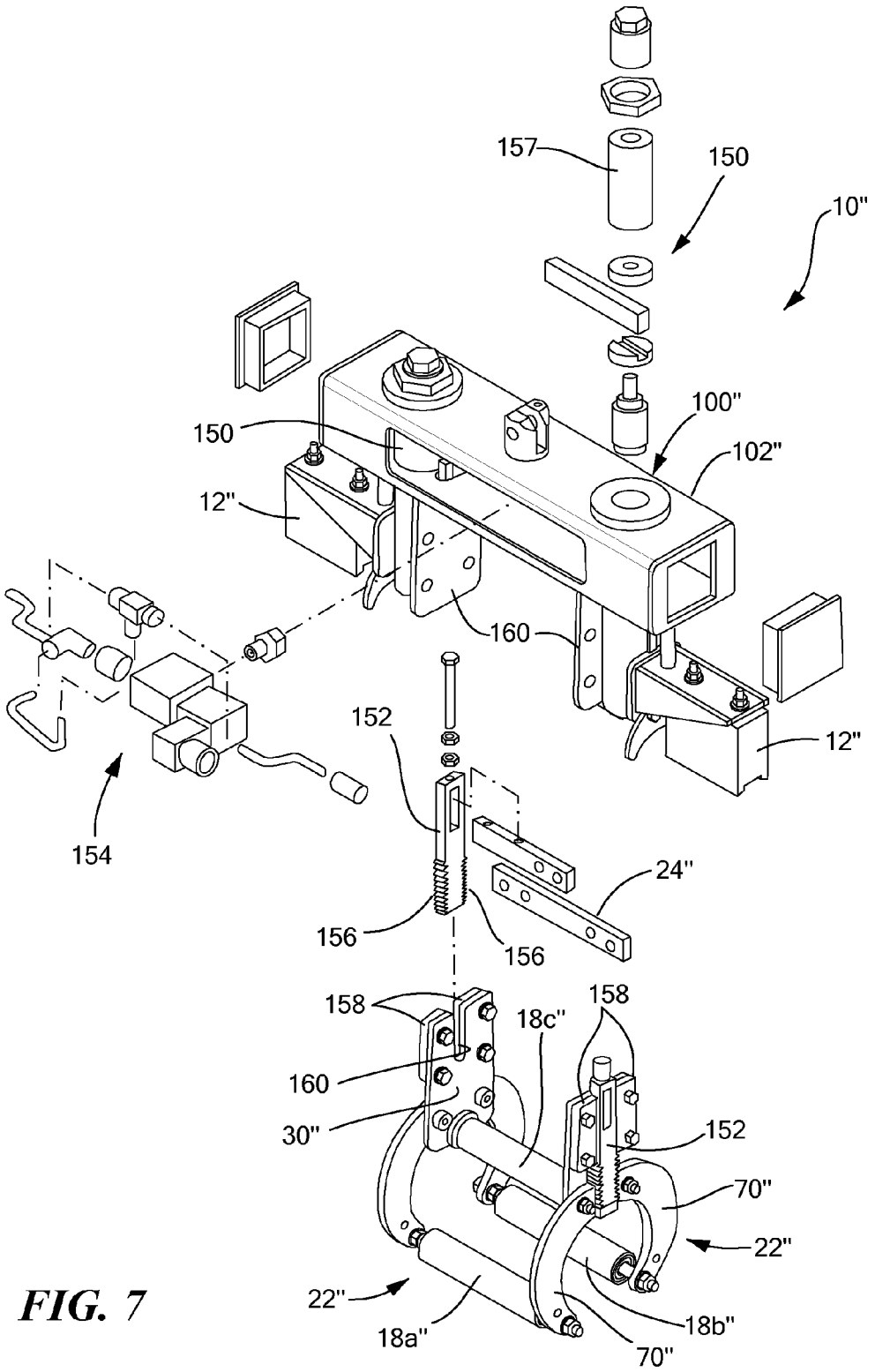
FIG. 7 is an exploded view of a third embodiment of a rod handling assembly.
Figure 8:
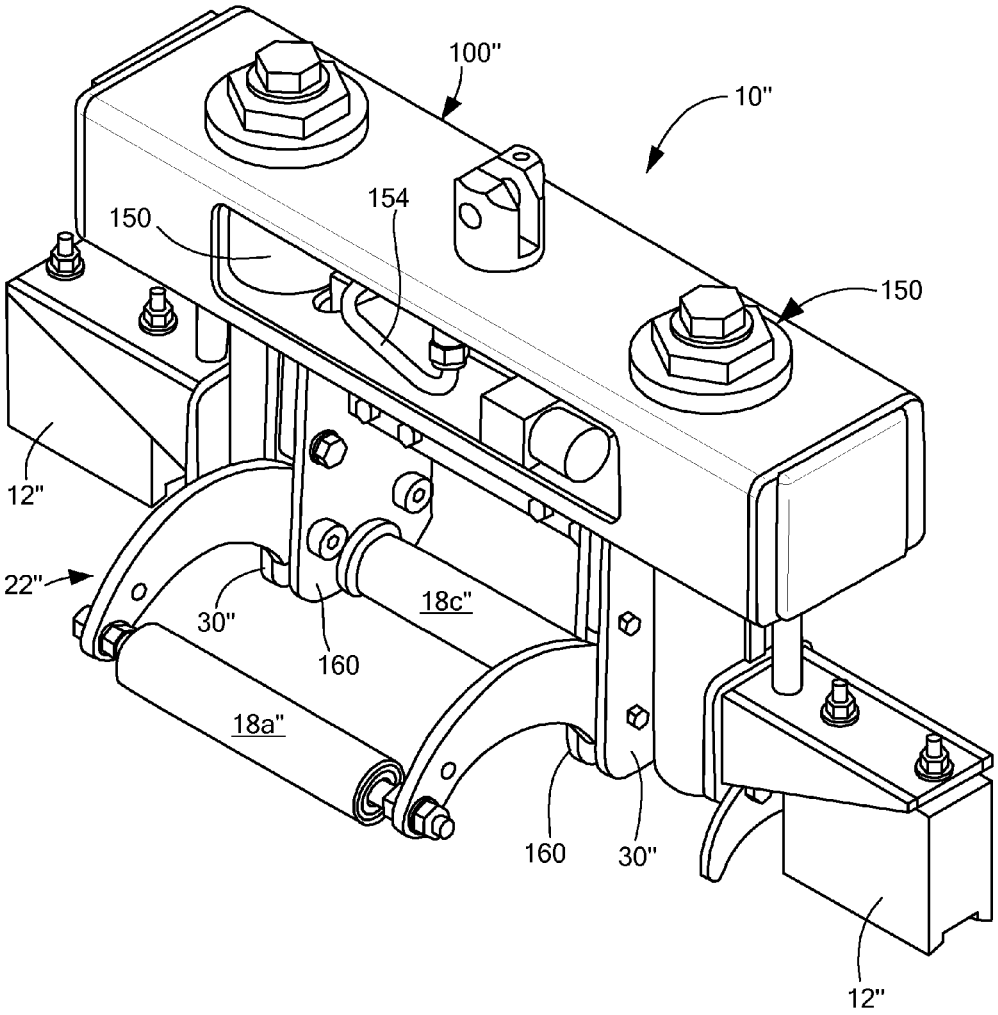
FIG. 8 is an isometric view of the third embodiment showing the holding assembly in the opened state; and, FIG. 9 is an isometric view of the third embodiment showing the holding mechanism in the closed state.
Figure 9:
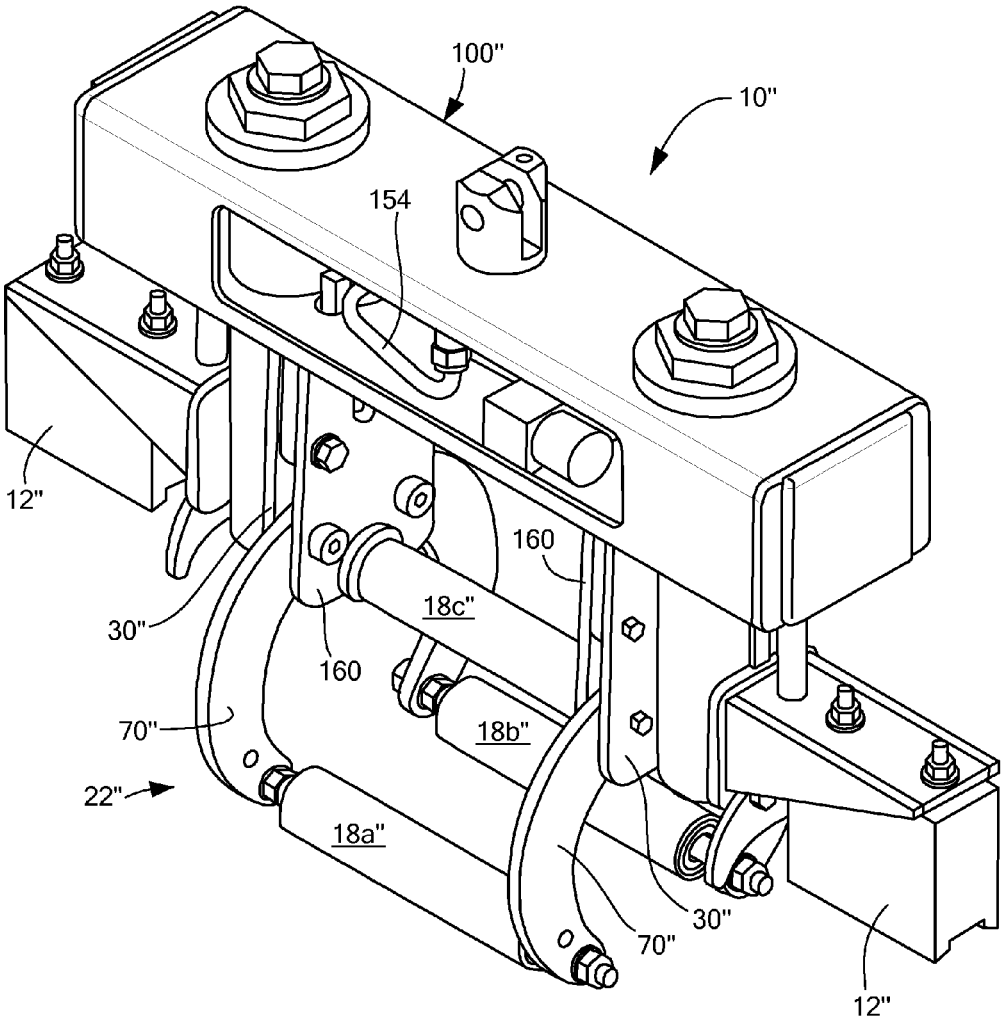

FIGS. 7-9 depict a third embodiment of the rod handling assembly denoted as 10". In describing the assembly 10" the same reference numbers as for assembly 10 but with the addition of a double prime (") suffix are used to denote the same or equivalent features. The assemblies 10 and 10" perform the same functions but have structural differences. The substantive structural difference between the assemblies 10 and 10" relates to the mechanism for moving the holding mechanism 14" between the closed and opened positions. Specifically, in the assembly 10", springs are used to bias the holding mechanism to the closed state shown in FIG. 9 and hydraulically powered actuators are provided for switching the holding mechanism 14" to the opened state shown in FIG. 8 against the bias of the springs. This provides a fail safe operation so that if power is cut off to the assembly 10", a gripped rod R remains gripped by the holding mechanism 14".

The hydraulic actuators comprise a plurality of components including a pair of hydraulic pistons 150, corresponding racks 152 and a hydraulic valve arrangement 154 which is in communication with a hydraulic pressure source and feeds the pressure equally to both of the pistons 150. Each rack 152 is formed with gear teeth 156 on opposite sides at a lower end. The teeth 156 are configured to engage with gear teeth formed on the curved strips 70" of each claw structure 22" at an end where the strips 70" are pivotally connected to the body 20". Thus sliding the rack 152 in opposite directions will cause opening and closing of the holding mechanism 14".

Respective springs (only one shown) 157 are associated with the pistons 150 and racks 152. Each spring 157 is arranged to bias its associated rack 152 to slide in a direction to cause the claw structures 22" to move to the closed position. However providing hydraulic pressure to the pistons 150 causes the racks 152 to slide in an opposite direction against their associated springs 157. Due to the meshing of the teeth 156 with the teeth on the curved strips 70", this causes the claw structures 22" to pivot to the open position as shown in FIG. 8.

In this embodiment, the body 22" comprises rectangular plates 30" which are coupled together at one end by a pin (not shown) on which the roller 18*c*" rotates. A pair of spacer plates 158 is attached to outwardly facing sides of the plates 30". The spacer plates 158 are disposed on opposite sides of longitudinal slots 160 formed in each of the plates 30". The racks 152 are connected together by a cross bar 24" which is able to slide longitudinally along the slots 160 in the plates 30" on operation of the hydraulic actuator. The body 20" and thus the holding mechanism 14" is coupled to the frame 100" via a pair of plates 162. The plates 162 are attached to and depend from cross bar 102" of the frame 100". The racks 152 are slidably retained between the plates 30" and 162, and guided to slide linearly by virtue of the spacer plates 158, and the connecting cross bar 24".

Thus, in the assembly 10", the holding mechanism 14" is spring biased to the closed state hydraulically operated to switch to the opened state. This contrasts with the assembly 10 where the corresponding holding mechanism 14 is manually moved or actuated between the opened and closed positions.

As will be understood by those of ordinary skill in the art, the hydraulic actuators described above in relation to the assembly 10", can be replaced with equivalent electrically operated or pneumatically operated actuators. It is also possible to arrange such actuators to operate to positively switch the holding mechanism between both the opened and closed states. However this does not provide the fail safe mode of operation described above.

Now that an embodiment of the rod handling assembly 10 has been described in detail it will be apparent to those skilled in the relevant arts that numerous modifications and variations may be made without departing from the basic inventive concepts. For example, one or more of the rotatable members 18 may be powered or driven by a motor to thereby rotate a rod R held by the holding mechanism 14. In a further variation, the surface engaging mechanism 12 may comprise more than two axially spaced parts. Further the surface engaging mechanism 12 may comprise two (or more) permanent magnets and a device for moving the permanent magnets to enable the magnets to selectively engage and disengage a rod R. In this variation, the permanent magnets would be in the form of bar magnets having a longitudinal face of a first surface area, and an end face of a second smaller surface area. The device for moving the permanent magnets is arrange to move the magnets between an engaged position where the respective longitudinal faces lie parallel to a rod R and a disengaged position where the longitudinal face is perpendicular to the length of a rod R. Provided of course that the size and strength of the magnets is correctly selected which could be done either by very simple trial and experimentation, or by relatively simple mathematical equation, the permanent magnets when in the engaged position present sufficient surface area and thus magnetic flux to attract a rod R with sufficient force to support the weight of the rod R. However when the permanent magnets are in the disengaged position, while they still attract the rod R, the amount of flux available through the reduced surface area is insufficient to lift the rod or at least maintain engagement of a rod R. In this way the permanent magnets can be used to selectively engage and disengage a rod R.

All such modifications and variations together with others that would be obvious to persons of ordinary skill in the art are deemed to be within the scope of the present invention the nature of which is to be determined from the above description and the appended claims.

The invention claimed is:

1. A rod handling assembly for lifting and moving a rod initially lying on its side, the assembly comprising:

a surface engagement mechanism and a holding mechanism coupled to the surface engagement mechanism, each of the surface engagement mechanism and holding mechanism configured to engage the rod from a location disposed radially adjacent a circumferential surface of the rod, wherein the holding mechanism is not capable of engaging the rod initially lying on its side until the rod is lifted a sufficient distance to allow the holding mechanism to engage and hold the rod;

the surface engagement mechanism operable to:

selectively engage an exposed surface of a rod from above the rod to directly lift the rod the sufficient distance to allow the holding mechanism to engage and hold the rod; and selectively disengage the exposed surface of the rod when the rod is held by the holding mechanism;

wherein the holding mechanism further comprises a rotatable member freely rotatable about a pin disposed along an axis parallel to a longitudinal axis of the rod in a manner that allows the rod to rotate freely about the longitudinal axis of the rod when the rod is held by the holding mechanism and the surface engagement mechanism has been operated to disengage the exposed surface of the rod.

2. The rod handling assembly according to claim 1 wherein the surface engagement mechanism is capable of engaging the exposed surface of a rod without encircling the rod.

3. The rod handling assembly according to claim 1 wherein the surface engagement mechanism is arranged to engage the rod at two or more axially spaced locations along the rod.

4. The rod handling assembly according to claim 3 wherein the holding mechanism holds a rod engaged by the surface engagement mechanism at a location between two of the axially spaced locations.

5. The rod handling assembly according to claim 1 wherein the holding mechanism has an open state enabling the holding mechanism to engage the rod and a closed state where the holding mechanism can encircle the rod from a location radially adjacent the circumferential surface of the rod location and inboard of opposite ends of the rod.

6. The rod handling assembly according to claim 1 comprising a motor arranged to rotate at least one of the rotatable member and thereby cause rotation of a rod held by the holding mechanism.

7. The rod handling assembly according to claim 1 wherein the holding mechanism has an open state enabling the surface engagement mechanism to engage the rod and a closed state where the holding mechanism can encircle the rod from a location radially adjacent the circumferential surface of the rod location and inboard of opposite ends of the rod, and wherein the holding mechanism comprises a body and at least one claw structure coupled and movable relative to the body wherein the at least one claw structure is moved to a first position when the holding mechanism is in the opened state and the at least one claw structure is moved to a second position when the holding mechanism is in the closed state.

8. The rod handling assembly according to claim 7 wherein the holding mechanism comprises a single claw structure and the single claw structure supports the at least one rotatable member.

9. The rod handling assembly according to claim 7 wherein the holding mechanism comprises two claw structures and each claw structure supports a respective rotatable member.

10. The rod handling assembly according to claim 7 wherein the at least one claw structure is arranged to pivotally move between the first and second positions.

11. The rod handling assembly according to claim 7 comprising two claw structures and wherein the two claw structures are arranged to linearly move between the first and second positions.

12. The rod handling assembly according claim 7 wherein the at least one claw structure is arranged to be manually movable between the first and second positions.

13. The rod handling assembly according to claim 12 comprising a latch arranged to hold the at least one claw structure in either of the first and second positions.

14. The rod handling assembly according to claim 7 comprising an actuator arranged to move the at least one claw structure between the first and second positions.

15. The rod handling assembly according to claim 14 comprising one or more springs arranged to bias the at least one claw structure to the second position, and wherein the actuator operates against the bias of the one or more spring to move the at least one claw structure to the first position.

16. The rod handling assembly of claim 7, comprising a lever pivotably connected to the body and linearly moveable relative to the body to allow for movement of the lever, and wherein movement of the lever translates to pivotal movement of the claw between the first and second positions.

17. The rod handling assembly of claim 16 comprising a latch arranged to hold the at least one claw structure in either of the first and second positions.

18. The rod handling assembly of claim 17, wherein the latch comprises first and second notches in the body and a plunger movable with the lever, the plunger having a locking end opposite a handle end, the locking end biased to self-locate within the notches and retractable from the notch by pulling the handle end, wherein the locking end is locatable in the first notch when the at least one claw structure is in the first position and locatable in the second notch when the at least one claw structure is in the second position.

19. The rod handling assembly of claim 18, wherein the body comprises a curved path between the first and second notches and the locking end is movable along the curved path to self-locate within the first or second notch.

20. The rod handling assembly of claim 7, comprising at least two rotatable members, wherein the body supports the at least one claw structure and one of the at least two rotatable members, and the at least one claw structure supports another of the at least two rotatable members.

21. The rod handling assembly of claim 20, wherein the at least one claw structure is pivotable about a first axis and the rotatable member supported by the body is rotatable about the first axis.

22. The rod handling assembly of claim 7, wherein the at least one claw structure comprises two spaced apart curved strips each coupled to one end of the pin.

23. The rod handling assembly according to claim 1 wherein the surface engagement mechanism comprises two magnets, one on each side of the holding mechanism.

24. A rod handling assembly comprising:

a surface engagement mechanism arranged to engage a rod at two or more axially spaced apart locations along the rod from a location disposed radially adjacent a circumferential surface of the rod; and a holding mechanism coupled to the surface engagement mechanism, the holding mechanism comprising a body and a holding structure coupled to and movable relative to the body between:

(i) an open state to engage the rod; and, (ii) a closed state where the holding mechanism can encircle the rod in order to hold the rod;

the holding structure arranged to engage the rod at a location centrally between the two axially spaced apart locations, from a location disposed radially adjacent a circumferential surface of the rod, the surface engagement mechanism operable to:

(i) selectively engage an exposed surface of a rod from above the rod to directly lift the rod a sufficient distance to allow the holding mechanism to engage and hold the rod;

ii) selectively disengage the exposed surface of the rod when the rod is held by the holding mechanism to allow the rod to rotate relative to the holding mechanism in order for the rod to be screwed onto a drill string; and wherein the holding structure further comprises a rotatable member freely rotatable about a pin disposed along an axis parallel to a longitudinal axis of the rod in a manner that allows the rod to rotate freely about the longitudinal axis of the rod when the rod is held by the holding mechanism and the surface engagement mechanism has been operated to disengage the exposed surface of the rod.

25. A method of operating a rod handling assembly according to claim 24, the method comprising the steps of:

(a) operating the surface engaging mechanism to engage a circumferential surface of a rod from above with the surface engagement mechanism;

(b) lifting the rod with the surface engagement mechanism;

(c) while the rod is lifted, engaging the rod with the holding mechanism and operating the surface engagement mechanism to disengage the rod, so that the rod is only held by the holding mechanism; and (d) rotating the rod while being held only by the holding mechanism in order to attach the rod to a drill string.

26. The method of claim 25, wherein after step (c) the method comprises moving the rod to a desired location for the rod to be screwed to a drill string while being held by the holding mechanism.

27. The method of claim 25, comprising operating the surface engagement mechanism to engage the circumferential surface of the rod using a magnetic force, and operating the surface engagement mechanism to disengage the surface engagement mechanism by releasing the rod from the magnetic force.

28. The method of claim 25, comprising rotating the rod using a powered motor to cause rotation of the rod.

29. The rod handling assembly of claim 24, wherein the holding structure is a claw structure including the pin and the rotatable member.

30. The rod handling assembly of claim 24, wherein the holding mechanism is not capable of engaging the rod initially lying on its side until the rod is lifted a sufficient distance to allow the holding mechanism to engage and hold the rod.

31. A rod handling assembly comprising:

a surface engagement mechanism and a holding mechanism coupled to the surface engagement mechanism, each of the surface engagement mechanism and holding mechanism configured to engage the rod from a location disposed radially adjacent a circumferential surface of the rod, the surface engagement mechanism operable to:

selectively engage an exposed surface of a rod from above the rod to directly lift the rod a sufficient distance to allow the holding mechanism to engage and hold the rod; and selectively disengage the exposed surface of the rod when the rod is held by the holding mechanism, wherein the holding mechanism further comprises a rotatable member freely rotatable about a pin disposed along an axis parallel to a longitudinal axis of the rod in a manner that allows the rod to rotate freely about the longitudinal axis of the rod when the rod is held by the holding mechanism and the surface engagement mechanism has been operated to disengage the exposed surface of the rod, wherein the holding mechanism comprises a body and at least one claw structure coupled and movable relative to the body between:

an open position to engage the rod; and, a closed position where the holding mechanism can encircle the rod in order to hold the rod;

the assembly further comprising a latch arranged to hold the at least one claw structure in either of the open position or the closed position;

wherein the latch comprises first and second notches in the body and a plunger movable with the lever, the plunger having a locking end opposite a handle end, the locking end biased to self-locate within the notches and retractable from the notch by pulling the handle end, wherein the locking end is locatable in the first notch when the at least one claw structure is in the open position and locatable in the second notch when the at least one claw structure is in the closed position.

32. The rod handling assembly of claim 31, wherein the body comprises a curved path between the first and second notches and the locking end is movable along the curved path to self-locate within the first or second notch.

33. The rod handling assembly of claim 31, wherein the lever is pivotably connected to the body and linearly moveable relative to the body to allow for movement of the lever, and wherein movement of the lever translates to pivotal movement of the claw between the first and second positions.

* * * * *